United States Patent [19]

Kulhawy

[11] Patent Number: 5,013,092

[45] Date of Patent: May 7, 1991

[54] SURFACE STRIPPING DEVICE

[76] Inventor: Nicholas Kulhawy, 5919-5th Street S.E., Calgary, Alberta, Canada, T2H 1L5

[21] Appl. No.: 539,705

[22] Filed: Jun. 18, 1990

[30] Foreign Application Priority Data

Sep. 28, 1989 [CA] Canada ..... 613822

[51] Int. Cl.[5] ..... A47L 11/14; B26B 3/08

[52] U.S. Cl. ..... 299/40; 15/236.07; 30/169

[58] Field of Search ..... 299/36, 39, 40, 41; 30/169, 170, 171, 347, 379, 379.5; 15/93 R, 236.07

[56] References Cited

U.S. PATENT DOCUMENTS

| | | | |
|---|---|---|---|
| 1,171,212 | 2/1916 | Kinne | 30/169 |
| 2,686,324 | 8/1954 | Costarella | 15/93 R |
| 2,738,966 | 3/1956 | Davis | 299/41 |
| 3,512,204 | 5/1970 | Jagiel | 15/93 R X |
| 4,614,380 | 9/1986 | Allen | 299/41 |
| 4,668,017 | 5/1987 | Peterson et al. | 299/37 |
| 4,860,450 | 8/1989 | Achille | 30/169 X |

FOREIGN PATENT DOCUMENTS

| | | |
|---|---|---|
| 105621 | 6/1907 | Canada . |
| 935283 | 10/1973 | Canada . |
| 1062910 | 9/1979 | Canada . |
| 1097856 | 3/1981 | Canada . |
| 1167640 | 5/1984 | Canada . |
| 1181236 | 1/1985 | Canada . |
| 1202482 | 4/1986 | Canada . |

*Primary Examiner*—Ramon S. Britts
*Assistant Examiner*—David J. Bagnell
*Attorney, Agent, or Firm*—Victor E. Libert

[57] ABSTRACT

A stripper device for use in removing a covering from a flat surface, such as tile from a floor. The device includes an elongated member or arm for pushing a blade over the surface, the arm having a connecting portion, for example, at an inner end for mounting on a fork-lift truck. At the outer end of the arm, there is provided a connector for the blade which is in the form of a disk having a sharp peripheral edge. The disk includes a mating connector, and preferable, the connectors of the blade and arm are in the form of a ball and socket combination so that the blade can rotate about a vertical axis, and the axis of rotation can vary relative to the arm so that the peripheral edge can lie flatly against the floor at all times. The disk has a convex upper surface which intersects a lower surface at a shallow angle relative to the horizontal plane containing the peripheral edge. The device is effective in removing a covering such as tile from a floor surface by pushing the arm across the floor so that a portion of the edge of the blade rotates under the edge of the covering. The device is of simpler construction than known floor strippers which have become complex, usually including a wheel carried frame mounting a motor driven rotating cutter or brush or oscillating blade.

15 Claims, 1 Drawing Sheet

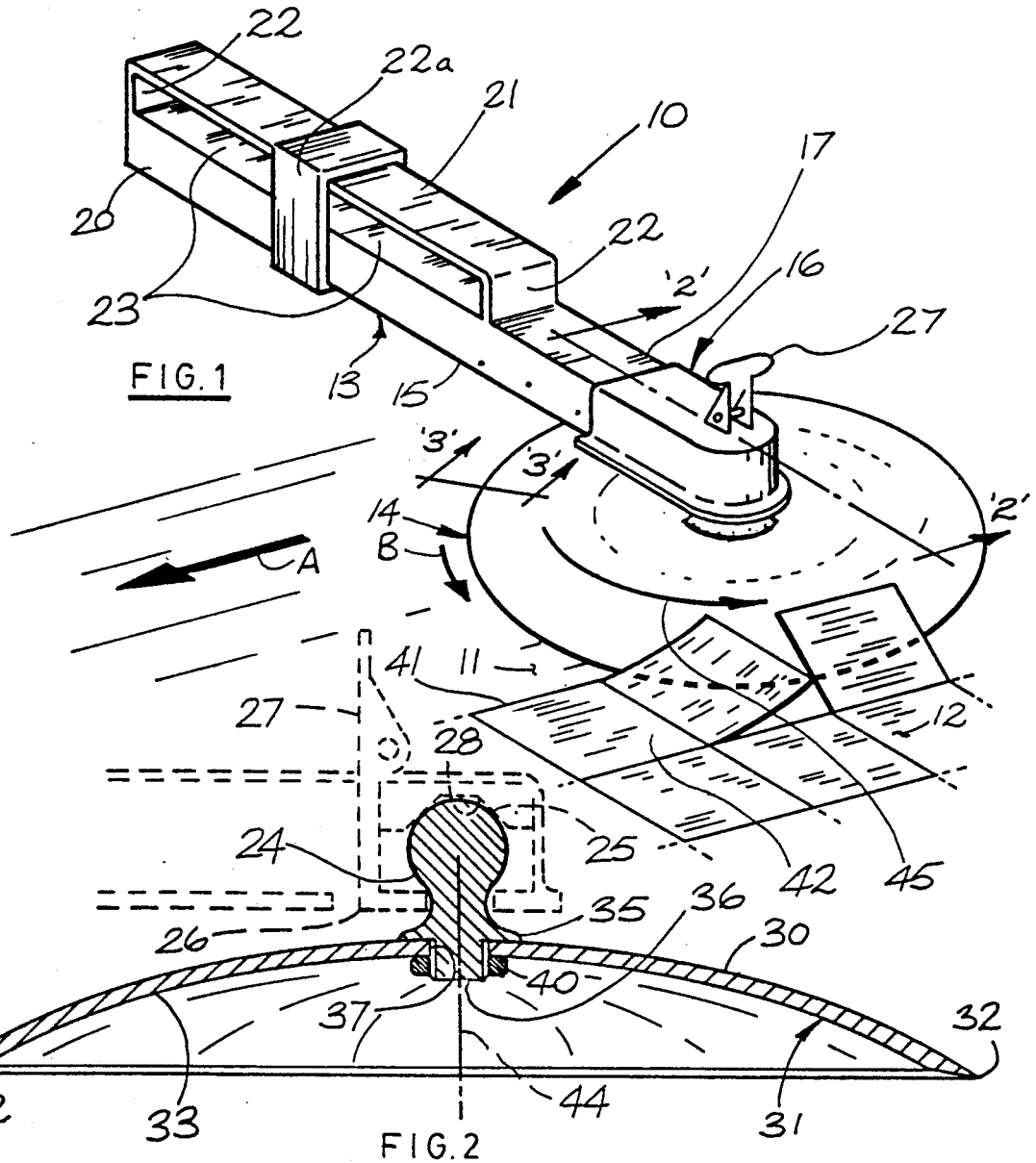
FIG. 1
FIG. 2
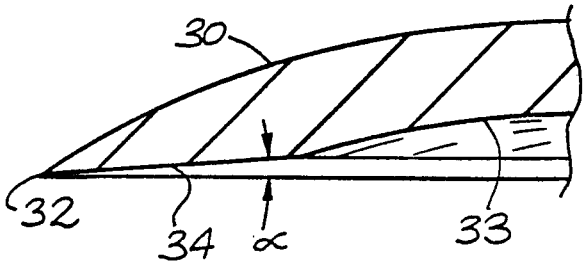
FIG. 3

SURFACE STRIPPING DEVICE

BACKGROUND OF THE INVENTION

1. Field of the Invention

This invention relates to a surface stripping apparatus, and more particularly, to a device for stripping material, such as a tile covering, from a floor surface.

2. Description of the Prior Art

For many years tools and machines have been developed for removing material, such as old tiles, floor covering and roofing from flat surfaces, usually for the purpose of placing the surface in a condition for receiving a new covering. For example, most floor covers, such as vinyl floor tiles have a limited life in relation to the floor structure, or it simply becomes desirable to lay new tile to give a fresh appearance, and before a new covering can be laid, the old tiles must be removed.

There is shown in Canadian Patent No. 105,621, dated June 4, 1907, to Kelling, a relatively simple structure for scrapping a floor surface, the structure including a wheeled truck having a push handle and carrying a fixed blade which is brought into a working position by the user tilting the truck. Latter developments, such as those shown in Canadian Patents No. 935,283, Oct. 16, 1973, to Blackwell; No. 1,062,910, Sept. 25, 1979, to Anderson; and No. 1,097,856, Mar. 24, 1981, to Schlemmer; and U.S. Pat. Nos. 4,614,380, Sept. 30, 1986, to Allen; and 4,668,017, May 26, 1987, to Peterson et al., have been of much more complex and expensive structures including, for example, a framework carrying a rotatable, oscillatory, or otherwise driven blade or brush structure, together with a drive motor or engine mounted on the framework. There exists, however, the need for a much less costly stripping device, having low maintenance requirements, and which will provide an effective stripping operation.

SUMMARY OF THE INVENTION

According to one aspect of the present invention, there is provided a blade member for a floor stripping device, the blade including a disk member having a circular peripheral shearing edge in a horizontal plane, an upper convex surface within the peripheral edge, and a lower surface including a central concave portion and a narrow annular portion surrounding the central portion, the peripheral edge being formed by the intersecting of the upper surface with the narrow annular portion at a shallow angle relative to the horizontal plane, and a mounting member projecting axially upwardly from the upper surface.

According to another aspect of the present invention, there is provided a stripper device for removing a covering from a flat surface, the device including a stripper blade including a disk member having an upper convex surface intersecting a lower surface at a shallow angle relative to a horizontal plane to form a circular peripheral shearing edge. A blade carrier frame member is provided for forcing the blade over the surface, and mounting means attaches the blade under the frame for rotation of the disc member relative to the frame about a central axis extending substantially normal to the plane of the periphery.

BRIEF DESCRIPTION OF THE DRAWINGS

In the accompanying drawings which show an embodiment of the invention as an example, FIG. 1 is a perspective view of the stripper device of the invention in a tile stripping position;

FIG. 2 is a cross section view as seen from the line 2—2 of FIG. 1, and showing the mounting frame in dashed lines; and FIG. 3 is an enlarged cross section view on an enlarged scale, as seen from the line 3—3 of FIG. 1 showing just the shearing edge of the blade.

DESCRIPTION OF A PREFERRED EMBODIMENT

In FIG. 1, the reference character 10 generally denotes the stripper device of the present invention. The stripper device 10 is designed to be moved over a surface, such as floor 11 for the purpose of removing a floor covering, such as tiles 12, the under sides of which are tightly adhered to the floor by a cement or other adhesive. The stripper device 10 includes a blade carrying frame member, hereinafter referred to as arm 13 on which is mounted blade 14.

The arm 13 is shown as an elongated rigid member 15, which may be a steel member of box cross section, having a blade mounting means 16 at an outer end 17 thereof. The arm may be designed to be pushed manually, but in the embodiment illustrated, the arm is made to be carried on the front of an existing motorized vehicle, such as a fork-lift truck (not shown) so that considerable force can be applied to the blade, as will be described in more detail below. At an inner end 20 of the arm 13, an elongated flat plate 21 extends along, but slightly spaced above, an upper surface of the elongated member. The plate 21 is affixed above the elongated member 15 by spaced vertical webs 22 and central connecting member 22*a* so as to provide a pair of slot-like openings 23 to receive the tines of the fork-lift truck. Thus, when the arm is mounted in front of the fork-lift truck with the tines projecting through the openings 23, and the fork-lift fork is driven forward, the arm is moved sideways in the direction of the arrow A.

In the illustrated embodiment, the blade mounting means 16 is a socket structure 25 which may be in the form of a commercially available hitch used on trailer tongues, while connecting means 24 provided on blade 14 may be in the form of a mating ball member for such a hitch. The socket structure is preferable designed to provide an interior spherical cavity 28 (FIG. 2) having a locking member 26, which is activated from exterior of the socket structure by a lever 27, to move to a locked position to entrap the connecting means provided in the illustrated embodiment by the ball member 24 within the cavity while still permitting rotation of the ball and at least a limited universal movement common to ball and socket connections.

The blade 14 is in the form of a disk having an upper convex surface 30 and a lower surface 31, the upper surface 30 intersecting the lower surface at a shallow angle relative to a horizontal plane so as to form a sharp, circular, peripheral shearing edge 32. Although it is not essential that the disk be hollow, it is preferable that the lower surface includes a central concave portion 33 surrounded by a narrow annular surface or portion 34. The central concave portion 33 and the upper surface 30 may have substantially the same curvature so that the disk is dish shaped, having substantially constant thickness throughout. Thus, the annular portion 34 simply extends across the thickness of the disk at an angle relative to the horizontal plane, the angle being of slope less than that of the upper surface. The intersection of the upper surface 30 and the slanted annular portion of the lower surface provides the sharp shearing edge. In a preferred form of the invention, the angle $\alpha C$ is about 5° (FIG. 3).

As previously indicated, the connected means on the blade is in the form of a ball member 24 centrally mounted on the disk and projecting axially above the upper surface 30. Rather than being formed as an integral unit with the disk, the ball member may have a stem portion provided with a flange 35 and a threaded shank 36. The disk is provided with a central opening 37 which receives the threaded shank so that a nut 40 can be threaded onto the shank. Thus the ball member is fixed to the blade by the disk being clamped between the flange 35 and the nut 40.

As the stripping device is driven forward in the direction of arrow A in the manner described above, the fork-lift truck is driven parallel to the edge 41 of the row 42 of tile 12 being stripped at a distance from the edge 41 so that a portion of the blade 14 slides under the row 42 of tile (FIG. 1). A downward pressure is applied to the arm 13 so as to force the blade tightly against the floor 11 and as the peripheral shearing edge 32 is in a flat plane, the entire edge lies against the floor. Even if the arm 13 is held at an angle relative to the floor, or if an irregularity in the floor is encountered, the blade remains flat against the surface because the rotating central axis is free to tilt at an angle relative to a position normal to the longitudinal axis of the arm because of the universal movement allowed by the connection of the ball and socket structure between the blade and the outer end of the arm. The sharp shearing edge 32, because of the shallow slope of the upper surface of the blade, pries under the edge of the tiles, lifting it sufficiently to cause the remainder of the tile to break free of its adhesive connection to the floor. As indicated, the shearing edge remains in complete contact with the floor, and due to the resistance caused by the one portion of the edge passing under the tile, the blade is forced to rotate in the direction of arrows B and 45 shown in FIG. 1 thus providing a slicing action under the tiles as the blade slides beneath the underside thereof. The action of the stripper device is the same, of course, whether the device is pushed in the direction of arrow A or in the opposite direction.

The rotation of the blade 14 is, as indicated above, about the axis 44, which is normal to plane of the peripheral shearing edge, or vertical as compared to a horizontal floor surface being stripped. If the arm 13 is parallel to the floor, the axis 44 is perpendicular to the longitudinal axis of the arm, but the angle is allowed to vary from 90° without lifting the peripheral shearing edge from its complete contact with the floor surface. Because the annular portion of the lower surface of the disk slopes upwardly at a slight angle, there is only a line contact with the floor which improves the shearing effect. Also, because of the hollow characteristic of the disk due to the concave undersurface, the line contact is virtually ensured even if the blade is pushed over an irregularity in the floor.

For the sake of safety and convenience in transport of the device from one work site to another, the blade can be readily removed from the arm 13 by simply actuating the lever the locking member to a ball releasing position. Also, it may be desirable to remove the blade for the purpose of replacing it or for maintenance, such as sharpening. Because of the type of connection provided between the ball member 24 and the disk, it is possible to readily replace either a worn ball member or damaged disk without having to acquire a completely new blade.

It is believed apparent from the above that the present invention provides a relatively simple structure which is inexpensive to produce and maintain. The device is easy to transport from one area to another and is capable of fast and simple operation, requiring a relatively unskilled operator.

An alternative embodiment of the invention may be in the form of a manually operable device which would be constructed in a much lighter form than the above described embodiment. In such an alternative embodiment, the arm 13 would be replaced with a light handle such as the long or "D" type handles provided on a shovel. The smaller and lighter blade replaces the type provided for a vehicle propelled version, and in use the operator would push the stripping device with the handle in front of him, i.e., the arm, which would be in the form of the handle would move more in a longitudinal direction than transversely as indicated by the arrow A in FIG. 1.

Although only one embodiment of the invention has been illustrated, alternatives within the spirit of the invention as defined in the appended claims will be obvious to those skilled in the art.

What I claim is:

1. A stripper device for removing a covering from a flat surface, said device comprising a stripper blade including a disk member having an upper convex surface intersecting a lower surface at a shallow angle in a horizontal plane to form a circular peripheral shearing edge, said disk member having a central axis extending substantially normal to the plane of said periphery, a blade carrier frame member for forcing said blade over the surface, mounting means attaching said blade under said frame for free-wheeling rotation of said disk member relative to said frame about said axis.

2. A stripper device as defined in claim 1, wherein said lower surface of said disk member includes a central concave portion.

3. A stripper device as defined in claim 2, wherein said lower surface of said disk member includes a narrow annular portion surrounding said central concave portion, said shearing edge being formed at the intersection of said upper convex surface with said narrow annular portion of said lower surface.

4. A stripper device for removing a covering from a flat surface, said device comprising a stripper blade including a disk member having an upper convex surface intersecting a lower surface at a shallow angle in a horizontal plane to form a circular peripheral shearing edge, said lower surface of said disk member including a central concave portion and a narrow annular portion surrounding said central concave portion, said shearing edge being formed at the intersection of said upper convex surface with said narrow annular portion of said lower surface, said narrow annular portion extending upwardly from said edge at an angle of less slope than the shallow angle of said upper surface, a blade carrier frame member for forcing said blade over the surface, mounting means attaching said blade under said frame for rotation of said disk member relative to said frame about an axis extending substantially normal to the plane of said periphery.

5. A stripper device as defined in claim 4, wherein said angle of said annular lower surface is at about 5° C. to the horizontal.

6. A stripper device as defined in claim 4, wherein said upper convex surface and said central concave portion are of substantially equal curvature whereby said disk member is dish shaped having a substantially constant thickness throughout.

7. A stripper device for removing a covering from a flat surface comprising:

a mounting arm having a blade mounting means at the outer end thereof, a stripper blade including a disk member having an upper convex surface intersecting a lower surface at a shallow angle in a horizontal plane to form a circular peripheral shearing edge, said blade having a connecting portion axially positioned on said upper convex surface, said connecting portion forming a mating universal connection with said mounting means for holding said blade below the outer end of said arm and permitting rotation of said blade about a central vertical axis.

8. A stripper device as defined in claim 7, wherein one of said mounting means and connecting portion being a ball member and the other being a socket receiving said ball member, said ball member being rotatable in said socket to accommodate said rotation of said blade while permitting the angle of the axis of rotation of said blade to vary relative to said arm.

9. A stripper device as defined in claim 8, wherein said socket is disposed in a lower portion of the outer end of said arm, and said ball member projects axially upwardly from the centre of said disk member.

10. A stripper as defined in claim 9, wherein said mounting means includes actuating means for opening said socket to release said ball member whereby said blade may be disconnected from said arm.

11. A stripper device as defined in claim 8, wherein said lower surface of said disk member includes a central concave portion, and a narrow annular portion surrounding said central concave portion, said shearing edge being formed at the intersection of said upper convex surface with said narrow annular portion of said lower surface.

12. A stripper device as defined in claim 11, wherein said upper convex surface and said central concave portion are of substantially equal curvature whereby said disk member is dish shaped having a substantially constant thickness throughout, said narrow annular portion extending upwardly across said thickness inwardly from said upper convex surface to said central concave portion at an angle of approximately 5° relative to said horizontal plane.

13. A blade member for a floor stripping device comprising:

a disk member having a circular peripheral shearing edge in a horizontal plane, an upper convex surface within said peripheral edge, and a lower surface including a central concave portion and a narrow annular portion surrounding said central portion, said peripheral edge being formed by the intersecting of said upper surface with the narrow annular portion at a shallow angle relative to said horizontal plane, said narrow annular portion extending upwardly from said edge at an angle of less slope than the shallow angle of said upper surface, and a mounting member projecting axially upwardly from said upper surface.

14. A blade member as defined in claim 13, wherein said angle of said narrow annular portion is at about 5° to the horizontal.

15. A blade member as defined in claim 13, wherein said upper convex surface and said central concave portion are of substantially equal curvature whereby said disk member is dish shaped having a substantially constant thickness throughout, said narrow annular portion extending upwardly across said thickness inwardly from said upper convex surface to said central concave portion at an angle of approximately 5° relative to said horizontal plane.

* * * * *